US010648236B2

(12) United States Patent
O'Donnell et al.

(10) Patent No.: US 10,648,236 B2
(45) Date of Patent: May 12, 2020

(54) LADDER SAFETY MECHANISMS

(71) Applicant: OD Tech Pty Limited, Parkes New South Wales (AU)

(72) Inventors: Peter O'Donnell, Parkes (AU); Ian Johnson, Newington (AU); George Rezk, Newington (AU)

(73) Assignee: OD TECH PTY LTD, Parkes, New South Wales (AU)

( * ) Notice: Subject to any disclaimer, the term of this patent is extended or adjusted under 35 U.S.C. 154(b) by 0 days.

(21) Appl. No.: 14/895,752

(22) PCT Filed: Jun. 5, 2014

(86) PCT No.: PCT/AU2014/000588
§ 371 (c)(1),
(2) Date: Dec. 3, 2015

(87) PCT Pub. No.: WO2014/194366
PCT Pub. Date: Dec. 11, 2014

(65) Prior Publication Data

US 2016/0115737 A1 Apr. 28, 2016

(30) Foreign Application Priority Data

Jun. 5, 2013 (AU) ..... 2013902102

(51) Int. Cl.
*E06C 7/48* (2006.01)
*E06C 7/18* (2006.01)
(Continued)

(52) U.S. Cl.
CPC ..... *E06C 7/48* (2013.01); *E06C 1/12* (2013.01); *E06C 1/34* (2013.01); *E06C 1/36* (2013.01);
(Continued)

(58) Field of Classification Search
CPC ..... E06C 7/48
See application file for complete search history.

(56) References Cited

U.S. PATENT DOCUMENTS 283,530 A * 8/1883 Swartz ..... E06C 7/12 182/102
1,281,336 A * 10/1918 Frazier ..... B63B 21/00 114/230.3
(Continued)

FOREIGN PATENT DOCUMENTS

EP 0232206 A2 8/1987
FR 2927391 A1 * 8/2009 ..... F16D 65/12
(Continued)

OTHER PUBLICATIONS

Extended European Search Report issued in connection with European Patent Application No. 14807375.2, dated Jan. 5, 2017, 7 pages.
(Continued)

*Primary Examiner* — Alvin C Chin-Shue
(74) *Attorney, Agent, or Firm* — Duane Morris LLP

(57) ABSTRACT

A ladder safety mechanism comprises at least one damp, preferably a pair of spaced apart damps, attachable part way along a ladder, to secure the ladder to part of a structure. In some embodiments, the mechanism includes at least one manually operated actuator, such as a rope or cable, coupled to the at least one clamp to enable a user located at the bottom of the ladder to open the at least one clamp to receive the part of a structure. In some embodiments, the at least one clamp is automatically secured to the part of the structure by placing the clamp onto the structure. The at least one manually operated actuator also enables a user located at the bottom of the ladder to open the at least one damp to release the part of the structure. The at least one clamp is oriented
(Continued)

substantially perpendicularly to a part of the structure to which the ladder is to be attached.

21 Claims, 11 Drawing Sheets

(51) Int. Cl.

| | |
|---|---|
| ***E06C 7/04*** | (2006.01) |
| ***E06C 1/12*** | (2006.01) |
| ***E06C 7/00*** | (2006.01) |
| ***E06C 7/42*** | (2006.01) |
| ***E06C 1/36*** | (2006.01) |
| ***E06C 1/34*** | (2006.01) |

(52) U.S. Cl.
CPC ..... *E06C 7/003* (2013.01); *E06C 7/04* (2013.01); *E06C 7/18* (2013.01); *E06C 7/42* (2013.01)

(56) References Cited

U.S. PATENT DOCUMENTS

| | | | | | |
|---|---|---|---|---|---|
| 1,622,971 | A * | 3/1927 | Porter | A62B 35/04 | 24/599.7 |
| 1,667,957 | A * | 5/1928 | Stevenson | B66C 1/36 | 24/599.5 |
| 2,116,880 | A * | 5/1938 | Dee | B63B 21/54 | 114/221 R |
| 2,550,770 | A * | 5/1951 | Calemmo | B63B 21/54 | 114/221 R |
| 2,936,849 | A * | 5/1960 | Larson | E06C 7/44 | 182/111 |
| 3,780,829 | A * | 12/1973 | Wallingford | E06C 1/36 | 182/206 |
| 4,311,209 | A * | 1/1982 | Primerano | E06C 1/36 | 182/107 |
| 4,607,726 | A * | 8/1986 | Davis | E06C 7/44 | 182/204 |
| 4,709,783 | A * | 12/1987 | Tomioka | A62B 1/00 | 182/198 |
| 4,995,476 | A * | 2/1991 | Buck | E06C 7/48 | 182/107 |
| 5,553,963 | A * | 9/1996 | Hoy | E06C 7/44 | 182/108 |
| 5,609,222 | A * | 3/1997 | Horbacewicz | E06C 7/44 | 182/109 |
| 5,752,581 | A * | 5/1998 | Orchowski | E06C 1/22 | 182/165 |
| 5,930,872 | A * | 8/1999 | McBride | F16L 33/02 | 24/19 |
| 6,044,930 | A * | 4/2000 | Hayman | E06C 7/48 | 182/107 |
| 6,854,562 | B2 | 2/2005 | Kwak | | |
| 8,011,476 | B1 | 9/2011 | Alcon | | |
| 8,348,014 | B2 | 1/2013 | Kerstetter, Jr. | | |
| 8,584,797 | B2 | 11/2013 | Krauss et al. | | |
| 8,776,947 | B1 * | 7/2014 | Wurth | E06C 1/12 | 14/69.5 |
| 8,974,137 | B2 * | 3/2015 | Parker | E02F 3/3618 | 37/468 |
| 2005/0284703 | A1 * | 12/2005 | Deuer | E06C 1/36 | 182/206 |
| 2007/0181370 | A1 * | 8/2007 | Kemp-Banks | E06C 1/12 | 182/204 |
| 2009/0229914 | A1 | 9/2009 | Liles | | |
| 2009/0242328 | A1 | 10/2009 | Cabrera et al. | | |
| 2010/0326768 | A1 * | 12/2010 | Kerstetter, Jr. | E06C 7/48 | 182/5 |
| 2012/0080263 | A1 | 4/2012 | Lee | | |

FOREIGN PATENT DOCUMENTS

| | | | |
|---|---|---|---|
| GB | 2404219 | A | 1/2005 |
| GB | 2447359 | A | 9/2008 |
| GB | 2459118 | A | 10/2009 |
| GB | 2476283 | A | 6/2011 |
| JP | S64-001890 | A | 6/1989 |
| JP | H07-026863 | A | 1/1995 |
| JP | 2000-345783 | A | 12/2000 |
| JP | 2000345783 | A | 12/2000 |
| JP | 2001-182467 | A | 7/2001 |
| NZ | 535807 | | 6/2005 |
| NZ | 587862 | | 2/2012 |
| WO | 2005/093201 | A1 | 10/2005 |
| WO | 2014/058911 | A1 | 4/2014 |

OTHER PUBLICATIONS

Japanese Office Action issued in connection with Japanese Patent Application No. 2016-517096, dated Apr. 3, 2018, 4 pages.
New Zealand Office Action issued in connection with New Zealand Patent Application No. 714338, dated Mar. 6, 2018, 6 pages.

* cited by examiner

LADDER SAFETY MECHANISMS

CROSS-REFERENCE TO RELATED PATENT APPLICATIONS

The present application is a U.S. national stage application under 35 U.S.C. § 371 of PCT Application No. PCT/AU2014/000588, filed Jun. 5, 2014, which claims priority to Australian patent application No. 2013902102,filed Jun. 5, 2013, the entireties of which are incorporated herein by reference.

FIELD OF THE INVENTION

The present invention relates to safety mechanisms and in particular, ladder safety mechanisms.

BACKGROUND TO THE INVENTION

Ladders are typically used to access places which are at a significant height above a surface. In use, ladders are typically rested on a surface and leant against an object or structure at an angle. The ladder is then climbed by a user.

One danger of using ladders is that when a user falls from a ladder they can fall a significant distance and be injured or killed. Falls from ladders may occur because a user slips from the ladder and/or because the ladder becomes unstable and/or falls. For example, if the user places the ladder at a steep angle and moves in a way that applies force to the ladder away from the structure or object, the ladder can fall away from the structure or object potentially causing injury or death. Similarly, if the user moves in a way that applies a sideways force to the ladder along the object, the ladder can tip sideways and fall with similar consequences for the user.

The prior art discloses numerous devices for securing ladders to structures, such as scaffolding or rails, however many such prior art devices require the first user of the ladder to ascend the ladder and secure the ladder in place with the device. Therefore, such devices offer no protection for the first user of the ladder.

In the prior art, United Kingdom Patent GB2426544 discloses a ladder mounting assembly to mount a ladder to a structure. The ladder mounting assembly comprises jaws to grab the structure. The jaws comprise two jaw members mounted on mounting members, which are in turn mounted on a track attached to the ladder. A remotely controlled motor can be provided for moving one or both of the mounting members along the track to grab the structure and hold the ladder in place. However, problems with the invention disclosed in GB2426544 are that it is large and complex. Consequently, it can be costly to produce and adds significant weight to the ladder potentially limiting the portability of the ladder. The motor also requires a power source. The mounting assembly of GB2426544 is therefore limited to specific applications.

United Kingdom Patent Application GB2447359 discloses increasing the stability of a ladder by securing a ladder to a pole. GB2447359 teaches a ladder comprising a horizontally arranged U-shaped member attached to an upper portion of the ladder. The U-shaped member receives a vertical pole and an arcuate member is pivotable relative to the U-shaped member. When a downward force is applied to a rope, the arcuate member is pivoted such that the arcuate member and the U-shaped member enclose the pole. The rope is then secured via a jam cleat to keep the arcuate member in place.

While GB2447359 teaches a simpler, lighter weight solution than GB2426544 to secure a ladder, the invention of GB2447359 is limited to the very specific use of securing a ladder to a pole and therefore is also limited in its application.

In the prior art, devices to minimise the effects of a user falling from a ladder have also been developed. GB2447359 teaches that a user can attach themself to a secured rope using a conventional rope grab. If the user falls the rope grab engages the rope and stops the fall of the user.

United States Patent Application 2012/0080263 discloses a roof ladder that attaches to a roof. A spring arrest anchor extends when a user slips down the roof then retracts when the user remounts the ladder.

The reference to any prior art in this specification is not, and should not be taken as, an acknowledgement or any form of suggestion that the prior art forms part of the common general knowledge.

OBJECT OF THE INVENTION

It is a preferred object of the embodiments of the present invention to provide a system and/or a method and/or an apparatus that addresses or at least ameliorates one or more of the aforementioned problems of the prior art and/or provides a useful commercial alternative.

SUMMARY OF THE INVENTION

Generally, embodiments of the present invention relate to safety mechanisms and in particular to ladder safety mechanisms.

According to one aspect, but not necessarily the broadest aspect, the present invention resides in a ladder safety mechanism comprising:

at least one clamp attachable part way along a ladder to secure the ladder to the structure; and at least one manually operated actuator coupled to the at least one clamp to enable a user located at the bottom of the ladder to open the at least one clamp to release the part of a structure;

wherein the at least one clamp is oriented substantially perpendicularly to a part of the structure to which the ladder is to be attached.

Preferably, the at least one clamp is automatically secured to the part of the structure by placing the clamp onto the part of the structure.

Suitably, the at least one manually operated actuator enables a user located at the bottom of the ladder to open the at least one clamp to receive the part of a structure.

Preferably, the ladder safety mechanism further comprises a manually operated adjuster to enable a user located at the bottom of the ladder to adjust the distance of the at least one clamp from the end of the ladder.

The ladder safety mechanism may further comprise at least one track removably attached to the ladder along which the at least one clamp can slide.

The at least one track may be attached to one or more rungs of the ladder and/or may be attached outside or inside a rail of the ladder.

Suitably, the at least one track can be attached to one or more rungs of the ladder with a u-shaped clamp comprising a toe to prevent rotation of the u-shaped clamp about the rung.

The at least one clamp may be slidably attached to the at least one track via a slider which is lockable in one of a plurality of predetermined positions along the track.

The slider may comprise a pair of manually operated actuators to control insertion and withdrawal of a pair of respective pins into and from respective apertures in the track.

Suitably, each pin is independently biased by a respective biasing element in a locked position when each pin is aligned with a respective aperture in the track.

Preferably, the slider comprises a visual indicator indicating whether the slider is in a locked position or an unlocked position. The visual indicator may comprise coloured ends of the pins which are visible through apertures in a body of the slider when the slider is in an unlocked position.

Preferably, the at least one clamp comprises a pair of spaced apart jaws to receive the part of the structure and at least one claw arm to secure the part of the structure within the clamp.

The at least one claw arm may be pivotally mounted to a housing of the clamp and pivotally mounted to a slider block movable within the housing, preferably such that a rate of opening or closing of the at least one claw arm is greater than a rate at which the slider block descends or ascends respectively, and preferably such that a gap between the part of the structure and the at least one claw arm is minimised irrespective of the size of the structure.

Suitably, the at least one claw arm is pivotally mounted to the housing via a movable pivot, a kidney shaped cam or a spring actuated cam.

Suitably, a wedge engages the slider block to lock the slider block and the at least one claw arm in position.

Preferably, the wedge is disengaged from the slider block to release the slider block and the at least one claw arm via the manually operated actuator, such as a rope or cable, connected to the wedge.

The safety mechanism may further comprise a biased latch to retain the wedge in a disengaged position without the need for the user to continue operating the actuator.

Preferably, the clamp includes a visual indicator to provide a visual indication of when the clamp is in a locked and unlocked position.

Suitably, the visual indicator is in the form of two coloured regions provided on a side of the wedge, wherein one or other of the two coloured regions is visible through an aperture in the housing of the clamp to indicate the clamp is in a locked or an unlocked position.

Preferably, the visual indicator is replicated in a respective cleat attached to a lower rung of the ladder to indicate to the user at the bottom of the ladder whether the respective clamp is in a locked or unlocked position.

Suitably, the manually operated actuator is in the form of a rope or cable routed through the ladder in a configuration to maintain substantially the same tension in the rope or cable when first and second ladder sections of the ladder are moved relative to each other.

Preferably, the ladder safety mechanism further comprises a fall protection device attachable to an upper portion of the ladder, the fall protection device attachable to the user and comprising a limiter to limit a fall of the user.

Suitably, the limiter is a speed limiter to limit the fall speed of the user.

Suitably, the limiter is a fall arrester to stop the fall of the user.

Preferably, a distance of the at least one clamp from an end of the ladder can be adjusted.

Preferably, the fall protection device comprises a reel-in, reel-out safety line.

The safety mechanism preferably further comprises one of the following to ensure a connector of the fall protection device is at the bottom of the ladder for connection to the user before they ascend the ladder:

- a fly lead attached at one end to the connector and secured at the other end at the bottom of the ladder;
- a retracting mechanism affixed at the bottom of the ladder, the retracting mechanism comprising a retractable line coupled to the connector;
- a rope or line loop mounted to a rail of the ladder and the connector can be coupled to the loop.

Preferably, the ladder safety mechanism further comprises a stabiliser attachable to the lower portion of the ladder.

Preferably, the stabiliser comprises one or more variable length connectors to adjust the angle of the stabiliser relative to the ladder.

Preferably, one or more parts of the ladder safety system, such as, but not limited to the at least one clamp, the at least one manually operated actuator, the fall protection device and/or the stabiliser, can be retrofitted to the ladder.

According to another aspect, the present invention resides in a ladder comprising the aforementioned ladder safety mechanism.

Further aspects and/or features of the present invention will become apparent from the following detailed description.

BRIEF DESCRIPTION OF THE DRAWINGS

In order that the invention may be readily understood and put into practical effect, reference will now be made to embodiments of the present invention with reference to the accompanying drawings, wherein like reference numbers refer to identical elements. The drawings are provided by way of example only, wherein.

Figure 1:
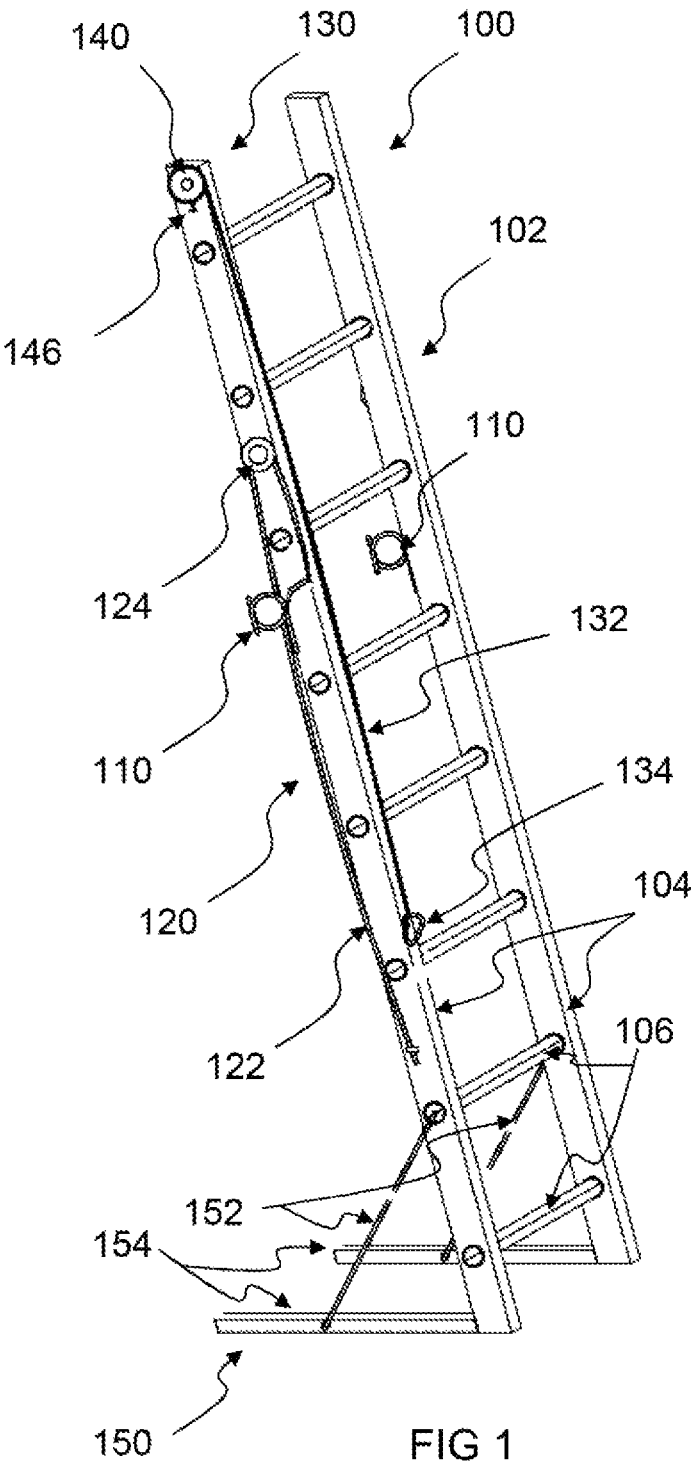
FIG. 1 illustrates a perspective view of a ladder safety mechanism attached to a ladder according to embodiments of the present invention.

Skilled addressees will appreciate that elements in the drawings are illustrated for simplicity and clarity and have not necessarily been drawn to scale. For example, the relative dimensions of some elements in the drawings may be distorted to help improve understanding of embodiments of the present invention.

DETAILED DESCRIPTION OF THE INVENTION

Embodiments of the present invention relate to safety mechanisms and will be described with reference to their implementation with ladders.

FIG. 1 is a diagram of a ladder safety mechanism 100 according to one embodiment of the present invention. The ladder safety mechanism 100 is attached to a ladder 102. The ladder 102 is a rigid ladder and comprises a plurality of rungs 106 coupled between rails 104. The safety mechanism 100 can be attached to the ladder 102 during production or supplied as a kit that can be retrofitted to a ladder, for example by a supplier or a user of the ladder.

The ladder safety mechanism 100 comprises at least one clamp 110 attachable part way along the ladder 102. The embodiment shown in FIG. 1 comprises two clamps 110, one clamp attached to each rail 104. However, it is envisaged that more than two clamps can be used depending on the application and/or the configuration of the ladder 102.

Each clamp 110 can be oriented substantially perpendicularly to a part of a structure to which the ladder 102 is to be secured. For example, as shown in FIG. 1, clamps 110 can be attached in a substantially vertical orientation for attaching to a substantially horizontally oriented scaffolding pole or other structure. Alternatively, clamps 110 can be attached in a substantially horizontal orientation for attaching to a substantially vertically oriented component of scaffolding or other structure.

Figure 5:
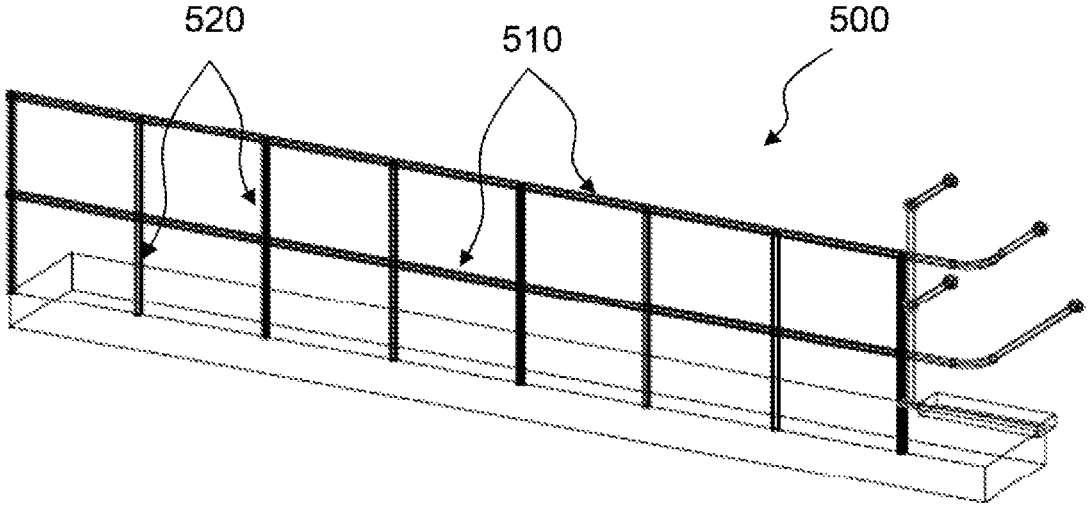
FIG. 5 illustrates an example of a structure to which the clamp of the ladder safety mechanism can be attached.

It is envisaged that in some embodiments, the clamp 110 is rotatable so the clamp 110 can be angled to suit the orientation of the part of the structure to which the clamps are being secured. Hence, the part of the structure to which the ladder can be attached can be oriented vertically, horizontally or at another angle, and be part of scaffolding, a metal bar or other suitable securing point, such as on a building site. An example of such a structure is shown in FIG. 5.

Whilst clamps 110 are shown in FIG. 1 as being suitable for clamping to a structure having a circular cross section, such as a scaffolding pole, clamps 110 are not limited to such a shape. Clamps 110 can be shaped to attach to a structure, or part thereof, having a different cross-sectional shape and/or size. Therefore, the clamp 110 can have a square shape for attachment to a structure having a square cross section and so on.

At least one actuator is coupled to the at least one clamp 110. The actuator enables a user located at the bottom of the ladder 100, e.g. at ground level, to open the at least one clamp 110 to receive part of the structure and to close the at least one clamp 110 to secure the ladder to the structure. In some embodiments, the actuator is a manually operated actuator 120. The at least one manually operated actuator 120 provides a mechanical connection between the user at the bottom of the ladder 102 and the at least one clamp 110. Alternatively, the actuator can be an electronic actuator. For example, the electronic actuator can be a motor coupled to the clamp 110 and controlled via a controller that is attached to the ladder or is a remote controller.

The embodiment shown in FIG. 1 comprises two manually operated actuators 120, one actuator 120 for each clamp 110. A manually operated actuator 120 can be provided for each clamp 100 used or a manually operated actuator 120 can be used with more than one clamp 110.

In some embodiments the manually operated actuator 120 comprises a rope or cable 122 attached to the at least one clamp 110. The rope or cable 122 can be attached near the bottom of the ladder 102, for example on the rail 104 below the third rung 106 up from the bottom of the ladder 102. In some embodiments the manually operated actuator 120 comprises a wheel 124, for example a sheave, attached near the top of the ladder, for example on the rail 104 above the third rung 106 down from the top of the ladder 102. The rope or cable 122 can be run from near the bottom of the ladder 102 via the wheel 124 to the at least one clamp 110 to enable the at least one clamp 110 to be actuated in an upward direction.

In some embodiments the ladder safety mechanism 100 further comprises a fall protection device 130. The fall protection device 130 comprises a reel device 140 attachable to an upper portion of the ladder 100, for example to the rail 104 above the top rung 106. The reel device is coupled to a retractable cable 132 attachable to the user, for example by a connector 134, such as a carabiner to couple to a belt or harness of the user. The retractable cable 132 is automatically reeled in or reeled out of the reel device 140 as the attached user moves toward or away from the reel device, respectively. The user can stay attached to the fall protection device whilst the user is not on the ladder, for example, when the user is working near the ladder or moving between ladders. The fall protection device 130 comprises a limiter 146 coupled to the reel device 140. In some embodiments, the limiter 146 is a speed limiter to limit the speed at which the retractable cable 132 can be reeled out of the reel device 140. The speed limiter 146 is load dependent and limits the speed at which a user of the ladder 102 can fall. The speed limiter 146 is shown more clearly in FIG. 6 and is discussed in more detail hereinafter. The limiter 146 can additionally or alternatively be a fall arrester to stop a fall of the user. In some embodiments, the cable 132 is designed to stretch and/or snap to reduce the maximum force on the user during the fall.

In some embodiments the ladder safety mechanism 100 comprises a stabiliser 150 attachable to a lower portion of the ladder 102. The stabiliser 150 comprises one or more adjustable feet 154 to be attached at the base of the ladder and one or more variable length connectors 152 coupled to the one or more adjustable feet 154 and the ladder 102. The one or more variable length connectors 152 adjust the angle of the one or more adjustable feet 154 relative to the ladder 102 to enable the ladder 102 to sit stably at a range of angles to a surface. In some embodiments, the one or more adjustable feet 154 are flexible to enable the one or more adjustable feet 154 to sit stably on a rough and/or bumpy surface. In some embodiments, the one or more adjustable feet 154 and/or the one or more variable length connectors 152 are spring loaded to enable the user to more easily position the ladder 102. The stabiliser 150 helps to prevent the ladder 102 from slipping on the surface.

Figure 2:
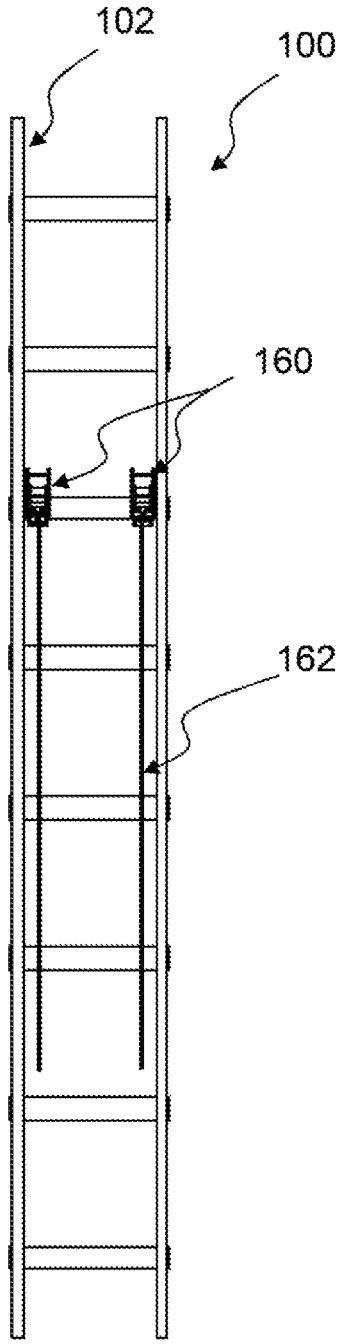
FIG. 2 illustrates a rear view of the ladder with an aspect of the ladder safety mechanism attached.

FIG. 2 illustrates a rear view of an aspect of the ladder safety mechanism 100 according to embodiments of the present invention. In these embodiments the distance of the at least one clamp 110 from an end of the ladder, for example the base of the ladder 102, can be adjusted. The distance of the at least one clamp 110 from the end of the ladder can be adjusted by moving the clamps directly and/or the ladder safety mechanism 100 can comprise at least one manually operated adjuster 160 to enable a user, such as a user located at the bottom of the ladder 102, to adjust the distance. The manually operated adjuster 160 enables the user to align the at least one damp 110 with the part of the structure, so the ladder can be secured to the structure easily whilst the user is at the bottom of the ladder, e.g., at ground level. In some embodiments, the manually operated adjuster 160 adjusts the position of the at least one clamp 110 along the ladder 102. For example, the at least one clamp 110 can be coupled to a track that is coupled to the ladder 102. In some embodiments, the manually operated adjuster 160 moves one section of the ladder 102 relative to another section of the ladder 102 to adjust the distance of the clamps 110 from an end of the ladder 102. For example, the ladder can be in the form of a ground operated extension ladder with the clamps 110 attached to the upper section of the extension ladder. In some embodiments, the manually operated adjuster 160 comprises a rope or cable 162 to enable a user at the bottom of the ladder 102 to adjust the distance of the clamps 110 from an end of the ladder 102.

Figure 3:
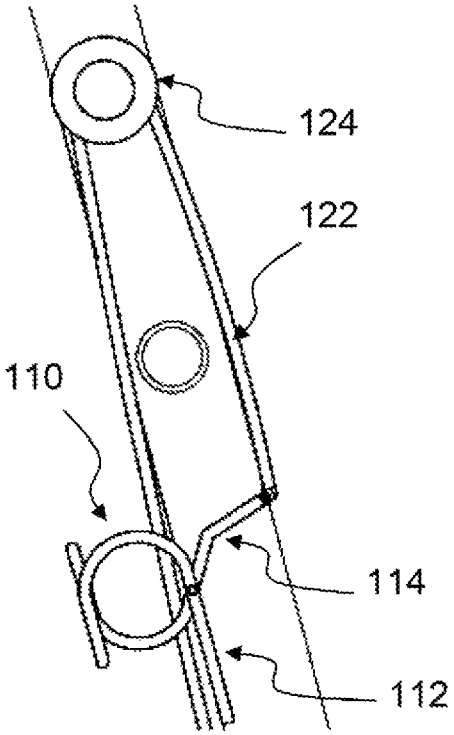
FIG. 3 illustrates a clamp of the ladder safety mechanism shown in FIG. 1 when the clamp is closed.

FIG. 3 illustrates the ladder safety mechanism 100 with the clamp 100 in a closed position according to one embodiment of the present invention. The clamp 110 comprises a first hook 112 and a second hook 114 pivotally attached to one another. The first hook 112 and the second hook 114 can be attached to the ladder 102 or the manually operated adjuster 160. The first hook 112 has a fixed alignment parallel to the ladder 102 to enable the ladder 102 to hook onto the horizontal part of the structure. In some embodiments the angle of the first hook 112 will be adjustable as detailed above. The second hook 114 is pivotal relative to the first hook 112 and the ladder 102 to enable the clamp 110 to be opened and the part of the structure to be received by the clamp 110. The wheel 124 is attached above the clamp 110 to enable the position of the clamp 110 along the ladder to be adjusted and to enable the rope or cable 122 to actuate the second hook 114 in an upward direction. Actuating the second hook 114 in an upward direction opens the clamp 112 as shown in FIG. 4.

Figure 4:
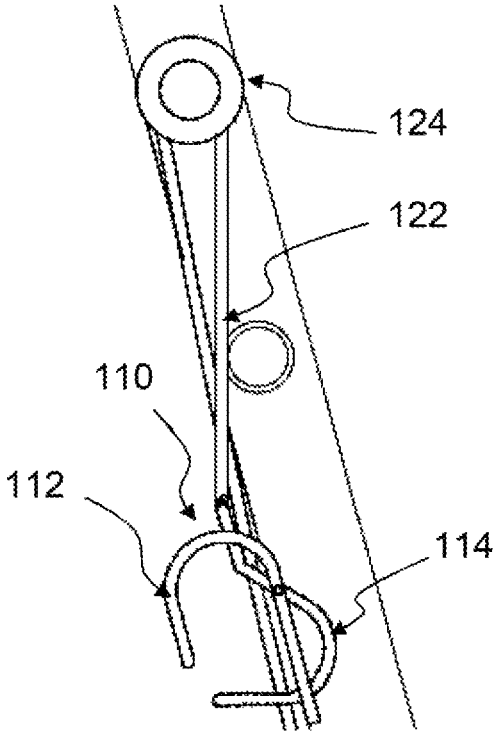
FIG. 4 illustrates the clamp shown in FIG. 1 when the clamp is open.

FIG. 4 illustrates the ladder safety mechanism 100 with the clamp in an open position according to one embodiment of the present invention. A force applied by the user to the rope or cable 122 has rotated the second hook 114 in a counter-clockwise direction from the position shown in FIG. 3 and opened the clamp 110. The fixed position of the first hook 112 relative to the part of structure enables the first hook 112 to securely hook over the structure and the second hook 114 can then be closed to secure the ladder 102. The ladder 102 can be secured in such a way to structures with a range of cross-sectional shapes and areas. For example, the part of the structure can be part of scaffolding, a rail on a building or any other suitable securing point.

FIG. 5 illustrates an example of a structure 500 to which the clamp 110 of the ladder safety mechanism 100 can be attached. The structure comprises substantially horizontal parts 510 and substantially vertical parts 520. The at least one clamp 110 can be oriented substantially vertically to secure the ladder 102 to one or more of the substantially horizontal parts 510 of the structure. Alternatively, the at least one clamp 110 can be oriented substantially horizontally to secure the ladder 102 to one or more of the substantially vertical parts 510 of the structure.

Figure 6:
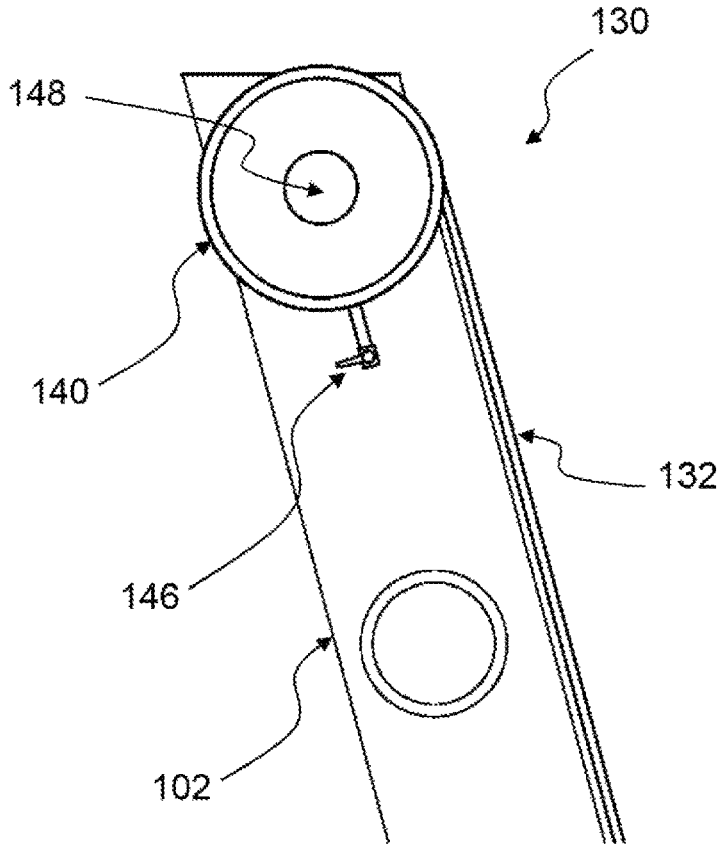
FIG. 6 illustrates a fall protection device of the ladder safety mechanism shown in FIG. 1.
Figure 7:
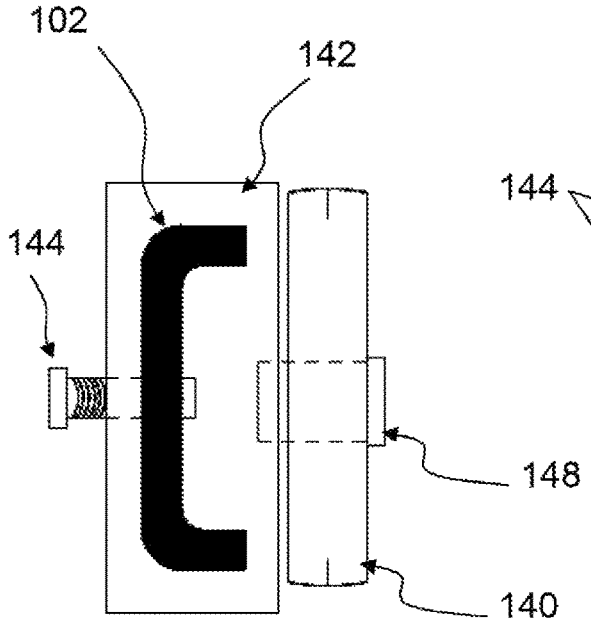
FIG. 7 illustrates a top view of an embodiment of the fall protection device shown in FIG. 6.
Figure 8:
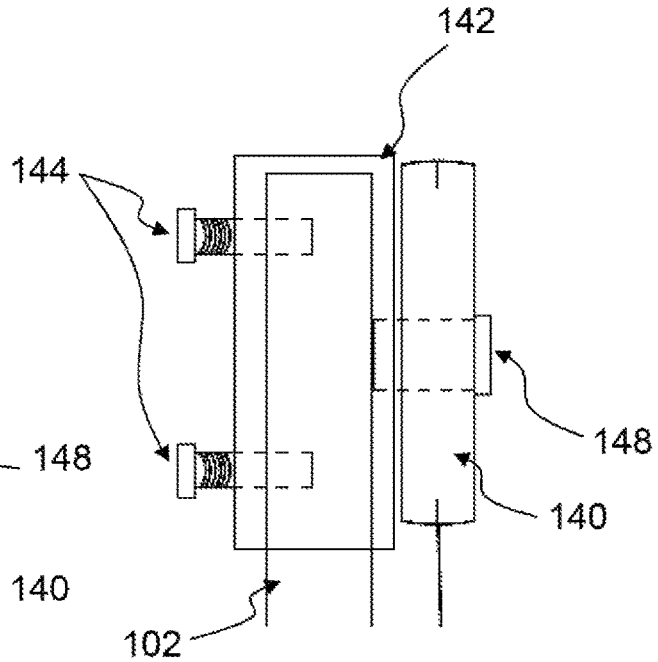
FIG. 8 illustrates a side view of an embodiment of the fall protection device shown in FIG. 6.

FIGS. 6, 7 and 8 illustrate the fall protection device 130 in more detail. The fall protection device 130 comprises sheath 142 that can be installed over the top end of the rail 104 of the ladder 102 to securely attach the fail protection device 130 to the ladder 102. The sheath 142 is secured to the rail 104 of the ladder 102 via fasteners 144. A pin 148 rotatably attaches the reel device 140 to the sheath 142. In some embodiments the pin 148 is an axle upon which the reel device 140 can rotate. In some embodiments, a limiter 146 detects when the reel device 140 exceeds a preset load and limits the speed at which the reel device 140 can rotate. In some embodiments, the limiter 146 detects when the reel device 140 exceeds a preset load and stops the reel device from rotating to arrest the fall of the user.

In alternative embodiments, the rope or cable 122 can perform the function of a limiter by stretching and/or by braking in a stretched condition to limit and/or slow the fall speed of the user.

Further embodiments of the present invention will now be described with reference to FIGS. 9 to 16.

Figure 9:
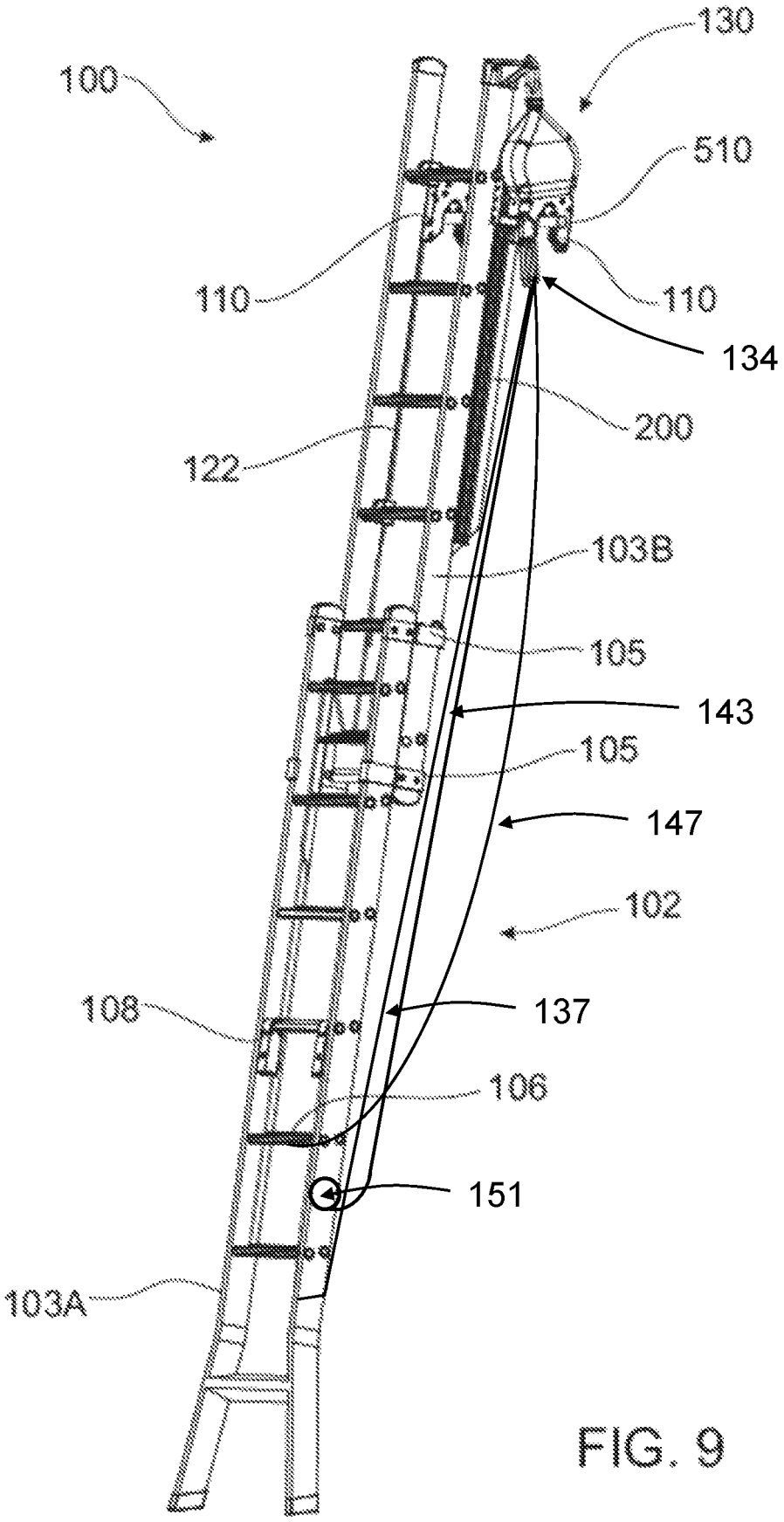
FIG. 9 illustrates a perspective view of a ladder safety mechanism according to other embodiments of the present invention attached to a ladder.

FIG. 9 shows another embodiment of the ladder safety mechanism 100 attached to a ladder 102. The ladder 102 is of a known type that comprises a first ladder section 103A and a second ladder section 103B (sometimes referred to as a fly section), slidable relative to the first ladder section 103A such that the ladder 102 can be extended to the desired height. The first and second ladder sections are slidably joined together via brackets 105. The rungs 106 of the ladder 102 have a circular cross section and a pair of spaced apart rungs 106 is provided at each level. The bottom rung between the splayed feet of the first ladder section 103A has a flat upper surface and a diverging thickness for strengthening purposes. However, other shapes of rung can be accommodated with the present invention. Furthermore, these embodiments of the present invention are equally applicable to ladders comprising a single ladder section and to ladders comprising more than two ladder sections.

The ladder safety mechanism 100 shown in FIG. 9 comprises a pair of spaced apart clamps 110 for attachment to a part of a structure, such as a rail 510, two small parts of which are shown in FIG. 9. Each clamp 110 is movable along a respective track 200 affixed to each side of the second section 103B of the ladder 102. Each clamp 110 is operated by a respective manually operated actuator 120 comprising a rope or cable 122 routed through the rungs 106 of the ladder 102. The rope or cable 122 is removably secured to a cleat 108 attached to one of the lower rungs of the ladder and the rope or cable 122 is thus accessible by a user at the bottom of the ladder, such as at ground level. The ladder safety mechanism 100 also comprises another embodiment of the fall protection device 130 attached to an upper portion of the second ladder section 103B. The aforementioned features shown in FIG. 9 will now be described in further detail.

Figure 10:
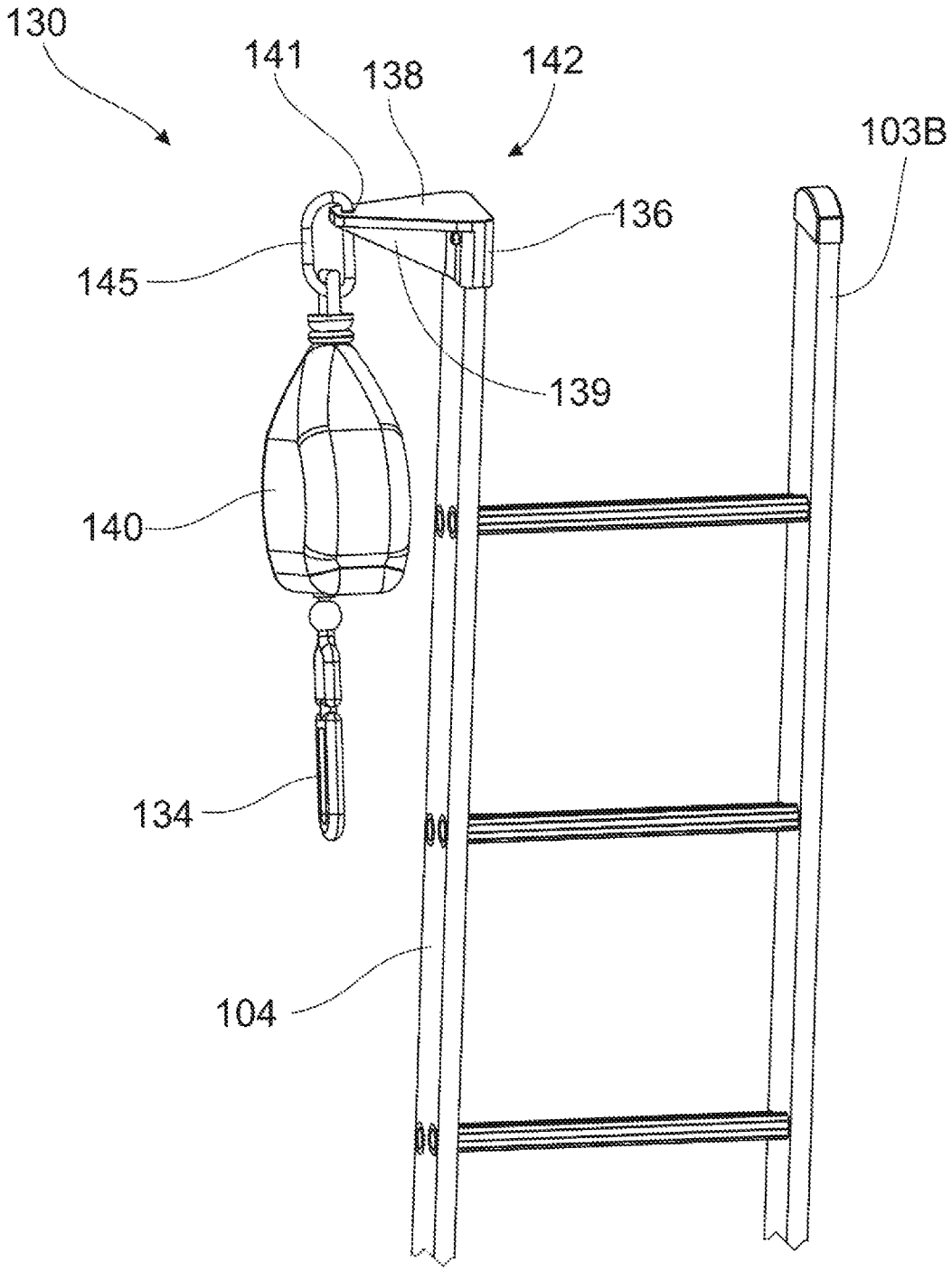
FIG. 10 illustrates a perspective view of the fall protection device coupled to the ladder shown in FIG. 9.

FIG. 10 shows the fall protection device 130 shown in FIG. 9. The sheath 142 attached to the top of the second ladder section 103B extends away from the rail 104 of the ladder 102 to provide clearance for the fall protection device 130 to move and operate. The sheath 142 comprises a hollow body 136 of a size and shape for receiving the top end of the rail 104. The sheath 142 comprises an arm 138 extending from the top of the hollow body 136 and one or more gussets or webs 139 extend perpendicularly between the hollow body 136 and the arm 138 to strengthen the sheath 142. The one or more gussets or webs 139 taper from the hollow body 139 toward a distal end of the arm 138. The sheath 142 can be affixed to the rail 104 with any suitable fasteners, for example, either side of the one or more gussets or webs 139. The sheath 142 can be made of any suitable plastics material molded into the required shape or can be formed from a suitable metal.

The distal end of the arm 138 comprises an aperture 141 through which a connector 145, such as a carabiner or other ring is passed. Connector 145 supports the reel device 140 and limiter 146, which can be in the form of a conventional fall limiting device or fall arrest device. The reel device 140 comprises the connector 134 for connecting to the user, for example via a harness or a belt.

The connector 134 must be at the bottom of the ladder 102 for use by the first user before they ascend the ladder and this can be ensured in a number of different ways. A fly lead 137 can be attached at one end to the connector 134 and secured at the other end at or toward the bottom of the ladder 102. The user can simply pull the fly lead to retrieve the connector for attachment to the user prior to ascending the ladder. Alternatively, a retractable line 143 can be coupled to the connector 134 with the retracting mechanism 151 affixed at or toward the bottom of the ladder such that the connector 134 is retained at or toward the bottom of the ladder 102 when not in use ready for connecting to the user. As a further alternative, a rope or line loop 147 can be mounted to one of the rails 104 of the ladder and the connector 134 can be coupled to the loop. Pulling on the loop 147 pulls the connector 134 into position at the bottom of the ladder for connection to the user prior to ascending the ladder.

Each of the above alternatives also enables the first user to disconnect from, the connector 134 and a subsequent user to move the connector 134 to the bottom of the ladder for connection to the subsequent user prior to the subsequent user ascending the ladder.

Figure 11:
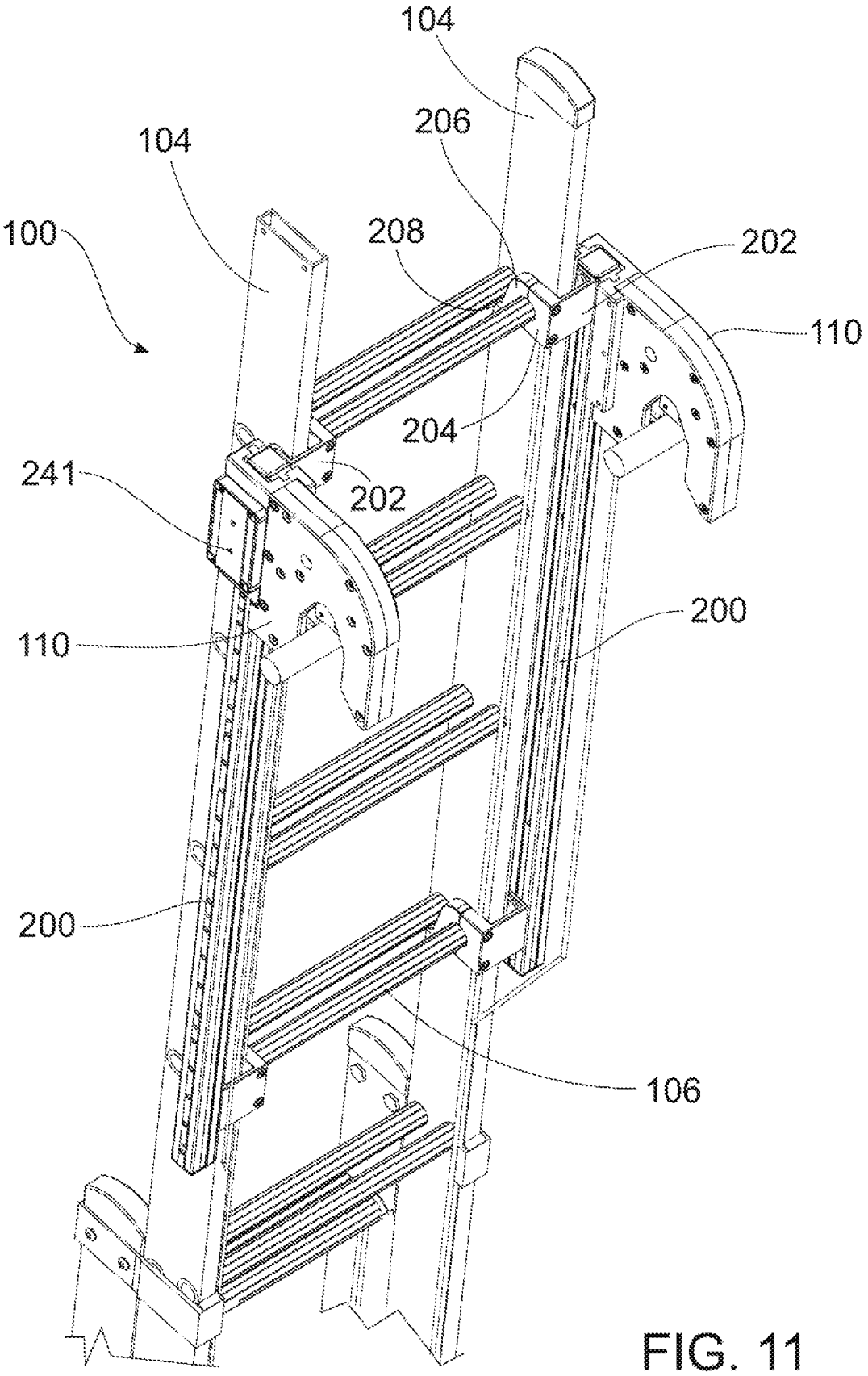
FIG. 11 illustrates an enlarged perspective view of the ladder safety mechanism shown in FIG. 9.

FIG. 11 shows an enlarged view of the ladder safety mechanism 100 shown in FIG. 9. Clamps 110 are movable along the respective track 200 affixed to each side of the ladder 102. Each track 200 runs parallel with and outside of a respective rail 104. Each track 200 is removably affixed to rungs 106 of the ladder by substantially u-shaped clamps 202 located toward the top and bottom of the track 200. The u-shaped clamp 202 receives one of the rails 104 within the u-shape, but there is sufficient clearance between the u-shape of the clamp 202 and the rail 104 to allow the passage therebetween of the brackets 105 connecting the first and second sections 103A, 103B of the ladder 102 together.

One side of the u-shaped clamp 202 located on an inner side of the rail 104 comprises two portions 204, 206, which are fastened together around a rung 106 using a pair of fasteners. Portions 204, 206 each comprise a recess to accommodate part of the rung 106. Portion 204 comprises a toe 208 to prevent rotation of the u-shaped clamp 202 about the rung 106. Portions 204, 206 and toe 208 are sized and shaped according to the size and shape of the rungs 106 of the ladder 102 to which the safety mechanism 100 is affixed. It will be appreciated that the size and shape of the recess in portions 204, 206 and the toe 208 can vary according to the size and shape of the rungs 106 of different types of ladders. Track 200 is affixed to the other side of the u-shaped clamp 202 on an outer side of the rail 104 using one or more suitable fasteners.

The u-shaped clamps 202 enable the tracks 200 to be removably affixed to the ladder 102 without the need to drill or otherwise damage the ladder. This avoids potentially voiding the manufacturers warranty for the ladder where the safety mechanism is retrofitted to the ladder and allows the ladder 102 to be returned to its original state if required.

Figure 12:
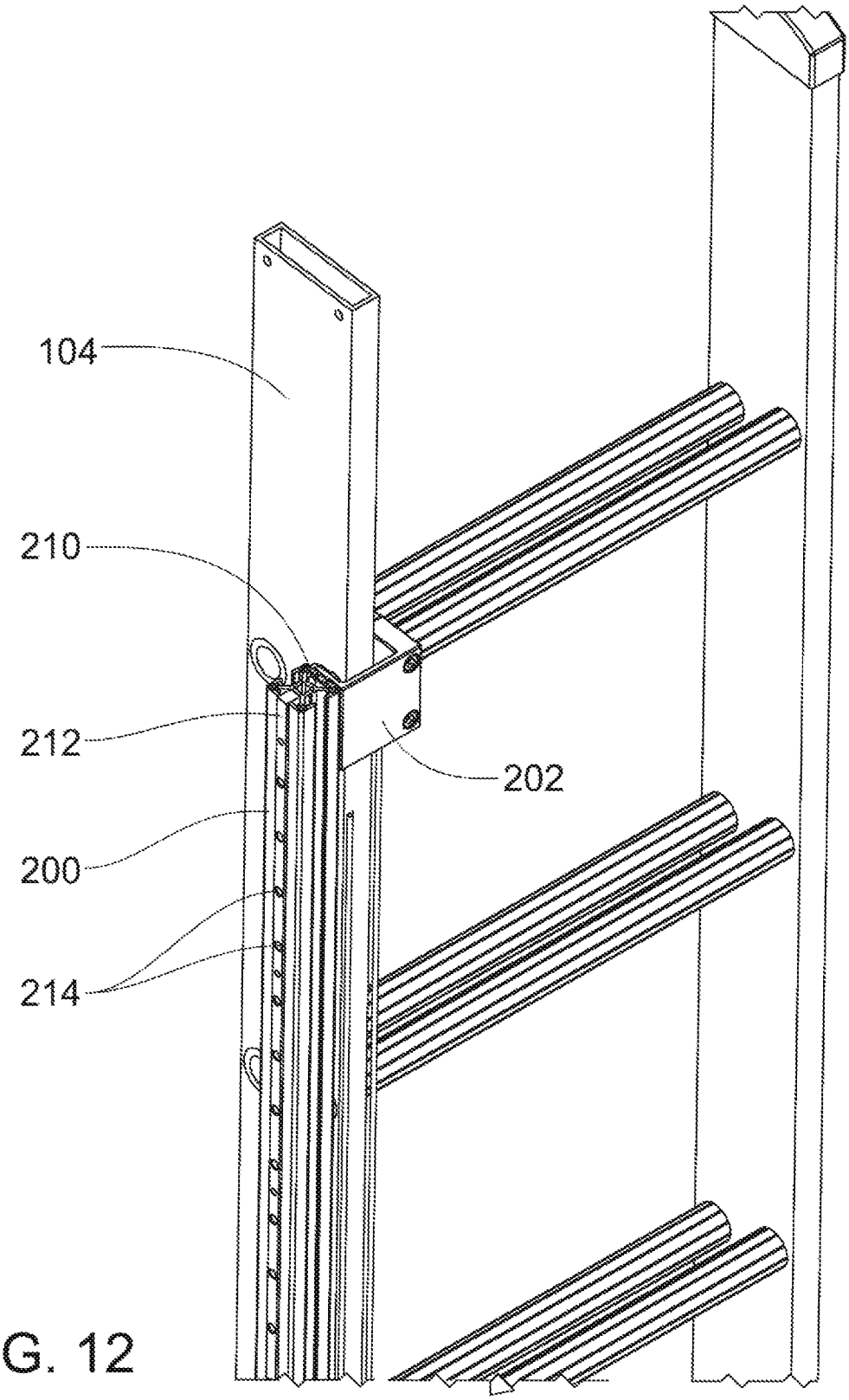
FIG. 12 illustrates a perspective view of a track of the ladder safety mechanism shown in FIG. 9.

With reference to FIG. 12, according to one embodiment, lightweight tracks 200 can be in the form of a known elongate section or extrusion available from Bosch Rexroth AG, although other sections can be used for the tracks 200. An insert 210 is received within and fixed to the track 200 by any suitable means. Insert 210 receives fasteners to affix the track 200 to the u-shaped clamp 202. A bar or rod 212, such as a ground steel bar, comprising a plurality of spaced apart apertures 214 is received within and fixed to the track 200 by any suitable means on an opposite side of the track to the insert 210. Apertures 214 receive pins for securing a respective one of the clamps 110 in one of a plurality of predetermined positions along the track 200 as will be described in further detail herein. According to some embodiments, tracks 200 provide a distance of about 2 m over which the clamps 110 can be positioned. However, it will be appreciated that the length of the tracks 200 can be varied according to the size and type of ladder to which the ladder safety mechanism 100 is applied.

Figure 13:
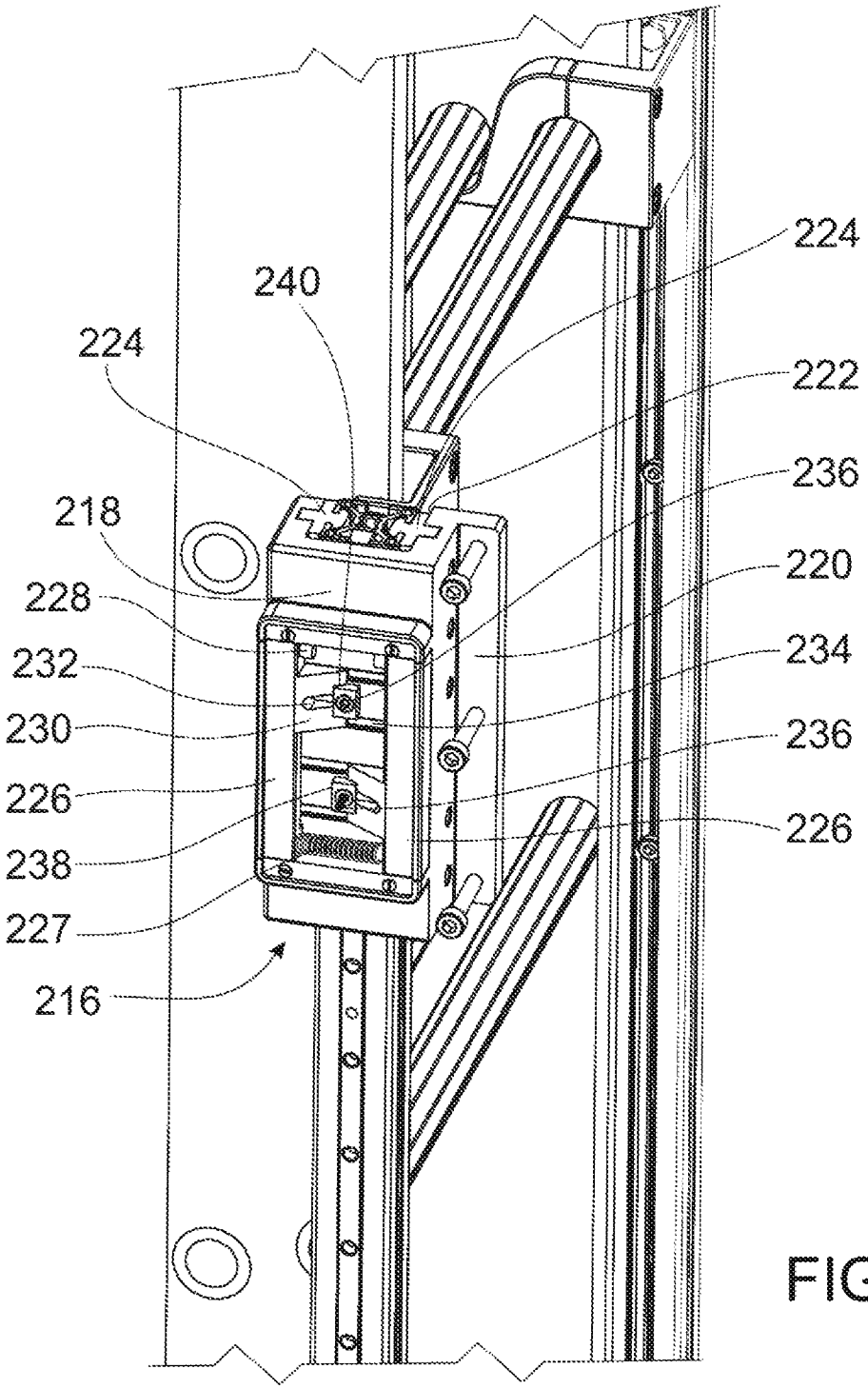
FIG. 13 illustrates a perspective view of a slider of the ladder safety mechanism shown in FIG. 9.

With reference to FIG. 13, each clamp 110 is movable along a respective track 200 by virtue of a slider 216. Slider 216 comprises a body 218 having a flange 220 to which clamp 110 is affixed, for example via a plurality of fasteners. The body 218 comprises a channel 222 for receiving the track 200. Inside walls of the channel 222 engage the track 200 to enable the slider 216 to move along the track 200. In this embodiment, slide strips 224 are received within and affixed to the inside walls of the channel 222. Slide strips 224 have a T-shaped protrusion received with the profile of the track 200. Slide strips 224 can be made of any suitable hard wearing, low friction material.

A cover plate has been removed from the body 216 in FIG. 13 for the sake of clarity. The body 218 of the slider 216 houses a pair of manually operated actuators or buttons 226. Buttons 226 are biased to the unactuated position shown in FIG. 13 by a pair of biasing elements, such as springs 227, which are held between lugs 228 of the buttons 226. One of the springs 227 has been removed from FIG. 13 for the sake of clarity. Each button comprises a wedge 230 having a slot 232, An underside of the wedge 230 comprises a pair of protrusions (not shown) each of which is received within a respective guide 234 in the body 218 of the slider 216 to guide movement of the buttons 226 when actuated by a user.

Slider 216 also comprises a pair of spaced apart pins 236 for engagement with apertures 214 in the track 200. Each pin 236 is independently biased by a biasing element, such as a spring, such that the pin is received within one of the apertures 214 when aligned therewith. Each pin 236 passes through a block 238 with an inclined surface 240. The block 238 is provided between the biasing element and the body 218 of the slider 216.

Hence, when the buttons 226 are actuated by the user, wedges 230 slide along guides 234 and slide against inclined surface 240 of a respective block 238, thus raising the block and the respective pin 236 to withdraw the pin from the aperture 214 in the track 200. When both pins 236 are withdrawn, the slider 216 with the attached clamp 110 can be moved to the desired position. The user can release the buttons 226 when the slider 216 has been moved. When the pins 236 are again aligned with respective apertures 214 in the track 200, the biasing elements will cause the pins 236 to engage the apertures 214 to secure the slider 216 in position. Each pin is independently biased and actuated to provide a fail safe in case one of the pins 236 becomes stuck. The pins 236 are engaged with the apertures 214 in the default position.

The slider 216 comprises a visual indicator indicating whether the pins 236 are in the locked or unlocked position. In some embodiments, the ends of the pins 236 are coloured red. When the pins are raised and not inserted into the apertures 214 in the track 200, the red ends of the pins 236 are visible through apertures 241 (shown in FIG. 11) in the cover plate of the body 216.

Each slider 216 and attached clamp 110 can be independently positioned at one of a number of predetermined positions along a respective track 200 for maximum flexibility in securing the ladder 102 to a range of structures.

Figure 14:
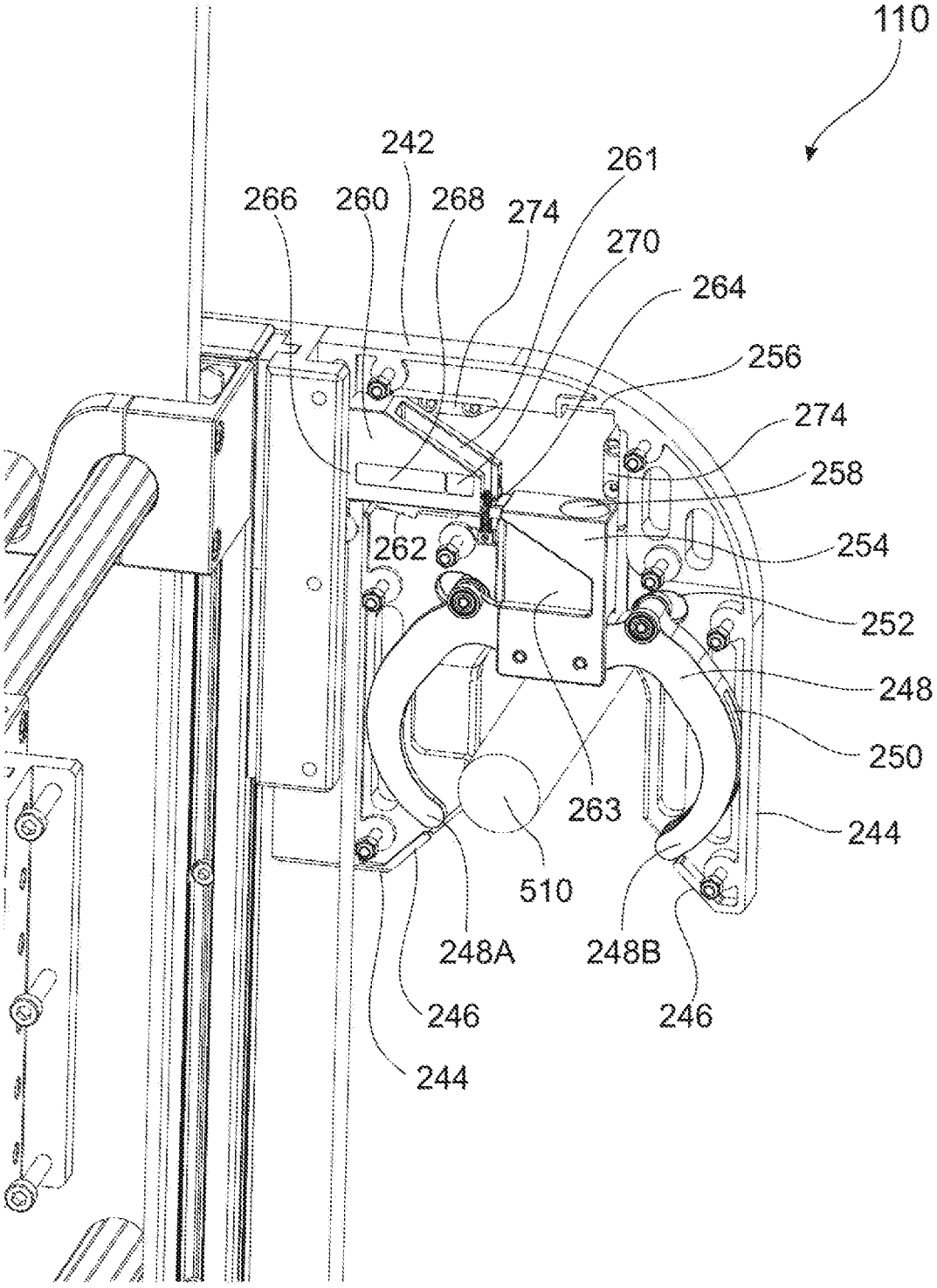
FIG. 14 illustrates a perspective view of a clamp of the ladder safety mechanism shown in FIG. 9 with part of a housing removed.

With reference to FIG. 14, each clamp 110 comprises a housing 242 formed from two parts joined together by any suitable fasteners. The two-part housing 242 allows access to the mechanism of the clamp for maintenance and repair. In one embodiment, the housing 242 is about 36 mm thick and made of aluminium for its strength and low mass, but other materials and sizes of clamp 110 can be employed according to the application.

FIG. 14 shows the clamp 110 with one part of the housing 242 removed to show the mechanism of the clamp 110. The clamp 110 comprises a pair of spaced apart jaws 244 for receiving part of structure, such as a rail 510 therebetween, to which the ladder 102 is to be secured. Each of the jaws 244 comprises an inclined edge 246 to maximize the opening for receiving the rail 510, which facilitates alignment of the clamps 110 with the rail by a user at the bottom of the ladder 102. In some embodiments, the jaws 244 are capable of receiving and securing a rail 510 of 30-60 mm in diameter, although it will be appreciated that clamps of different sizes can be produced within the scope of the present invention to accommodate other sizes of rails and other structures.

The clamp 110 comprises a claw 248 for securing the clamp to the rail 510 when the rail is between the jaws 244. In this embodiment, the claw 248 comprises two claw arms 248A, 248B, one of which is received at least partially within the other when the claw is in a closed or partially closed position. For example, claw arm 2486 comprises a slot 250 for receiving claw arm 248A. Each claw arm is pivotally mounted to one part of the housing 242, for example, via a movable pivot, such as a kidney shaped cam 252 as shown in FIG. 14. The kidney shaped cam 252 allows movement of the pivot points of the claw arms 248A, 248B, which helps to maximise contact between the claw arms and the rail 510 and minimise gaps therebetween irrespective of the diameter of the rail.

An end of each claw arm 248A, 248B is pivotally coupled within, and to a slider block 254 by any suitable fastener. Slider block 254 is capable of moving up and down within the housing 242. A biasing element, such as a spring (not shown) extends between a recess 256 of the housing 242 and into aperture 258 in the slider block 254. The biasing element biases the slider block 254 into the lower position shown in FIG. 14 such that the claw arms 248A, 248B are in the open position. The mechanism of the clamp 110 also comprises a wedge 260 that is capable of engaging the slider block 254 when the slider block is in an upper position. For example, wedge 260 comprises a channel 261 for receiving the slider block 254 and the slider block 254 comprises wedge shaped recesses 263 for receiving the wedge 260. A biasing element, such as a spring (not shown) extends between another recess of the housing 242 and into an aperture (not shown) in a rear of the wedge 260 to bias the wedge toward the right hand side of the housing 242. However, the wedge 260 is retained in a disengaged position toward the left hand side of the housing 242 shown in FIG. 14 by the top of the slider block 254. A gap is shown in FIG. 14, but the wedge 260 would ordinarily touch the slider block 254.

In use, when a user places the clamp 10 onto a structure, or part of a structure, such as the rail 510, the rail 510 pushes the slider block 254 upwards further into the housing 242. This causes the claw arms 248A, 248B to pivot about the pivot points with the slider block 254 and about the kidney shaped cams 252 causing the claw arms to close around the rail 510. Eventually the rail 510 abuts against the jaws 244 of the clamp 110 and the claw arms abut against the rail 510. As this occurs, the wedge 260 is biased toward the right hand side and engages the slider block 254 to lock the slider block 254 and thus the claw arms in position. The rail 510 is therefore securely retained within the clamp 110. Hence, the clamp 110 is automatically secured to the part of the structure 510 by the user placing the clamp onto the structure from the user's position at the bottom of the ladder 102.

To unlock the clamp 110, a user pulls on the actuator 120, such as the rope or cable 122, which is connected to the wedge 260 thus pulling the wedge 260 toward the left hand side of the housing 242. As this occurs, a latch 262, which is biased in an upward direction via a biasing element, such as a spring 264, is forced upward to retain the wedge 260 toward the left hand side of the housing 242 without the need for the user to continue operating the actuator 120, such as keep pulling the rope/cable 122. The slider block 254 is thus unlocked and free to move downwards under the force of its respective biasing element. As the slider block 254 moves downwards, the claw arms 248A, 248B open to release the clamp 110 from the rail 510. As the slider block 254 moves downwards, the slider block pushes the latch 262 downwards to release the wedge 260, which is forced to the right under the force of its respective biasing element into the starting position.

The arrangement of the slider block 254 and the claw arms 248A, 248B is such that the rate of opening of the claw arms is greater than the rate at which the slider block descends. This ensures that the claw arms are sufficiently retracted that the clamp 110 can be removed from the rail 510. Similarly, the claw arms close at a faster rate than the slider block 254 ascends such that the claw arms prevent the rail 510 or other part of a structure from being released before the rail 510 is fully in position within the clamp 110.

The clamp 110 includes one or more replaceable wear strips 274 affixed to the inside of the housing 242 to facilitate smooth motion and minimise sticking of the slider block 254 and/or the wedge 260.

Wedge 260 includes a visual indicator 266 on a side face of the wedge to provide a visual indication of when the clamp 110 is in a locked position and in an unlocked position. In the embodiment shown, the visual indicator is, for example, in the form of two coloured regions. A first, larger region 268 can be coloured green to indicate that the clamp 110 is in a locked position. A second, smaller region 270 can be coloured red to indicate that the clamp 110 is in an unlocked position. One or other of the two coloured regions is visible through an aperture 272 in the housing 242 of the clamp 110. The second, smaller region 270 is visible through the aperture 272 when the wedge 260 is towards the left hand side and disengaged from the slider block 254. The first, larger region 268 is visible through the aperture 272 when the wedge 260 is towards the right hand side and engaged with the slider block 254.

Figure 15:
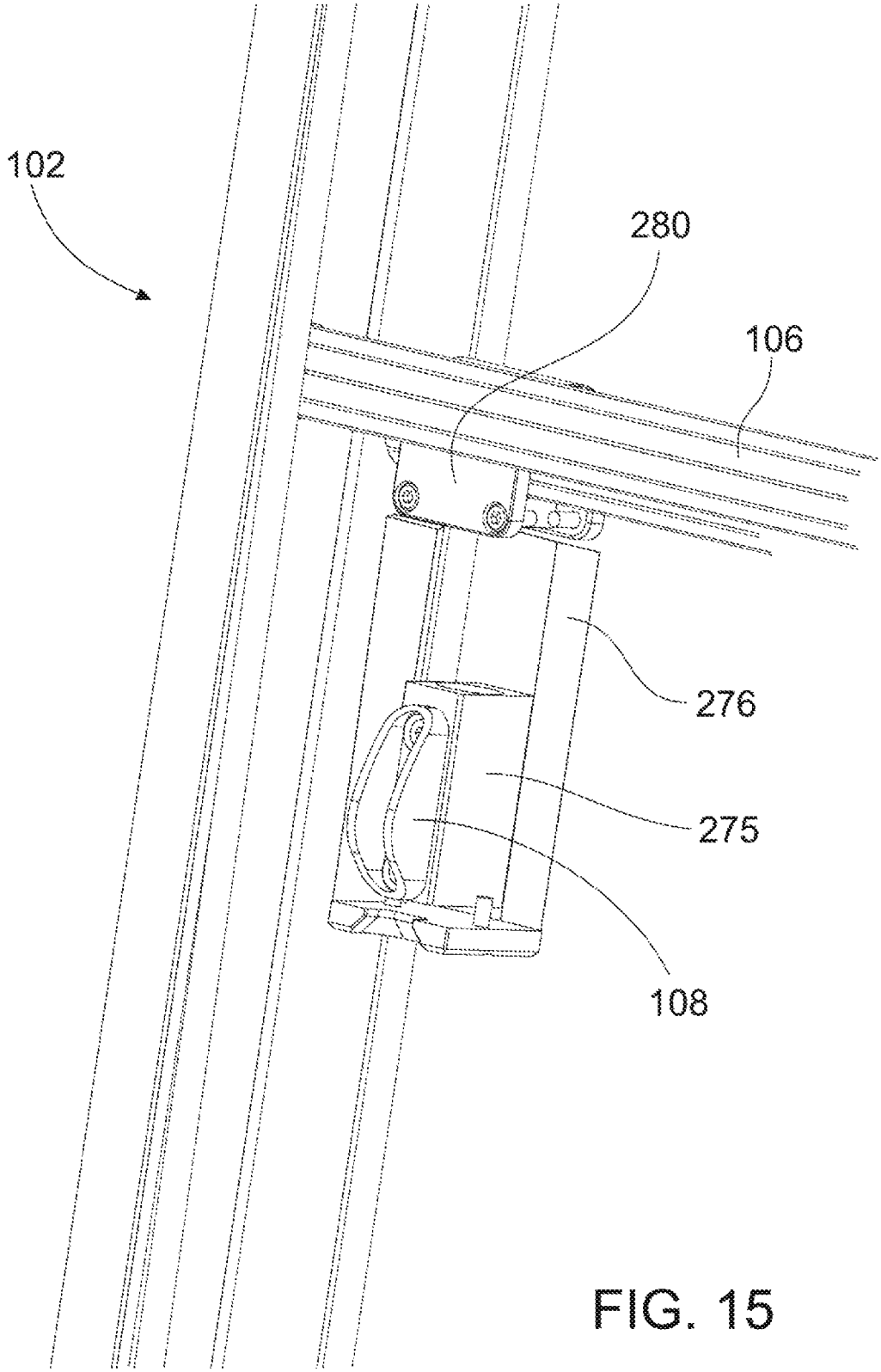
FIG. 15 illustrates a partially transparent perspective view of a cleat of the ladder safety mechanism shown in FIG. 9.
Figure 16:
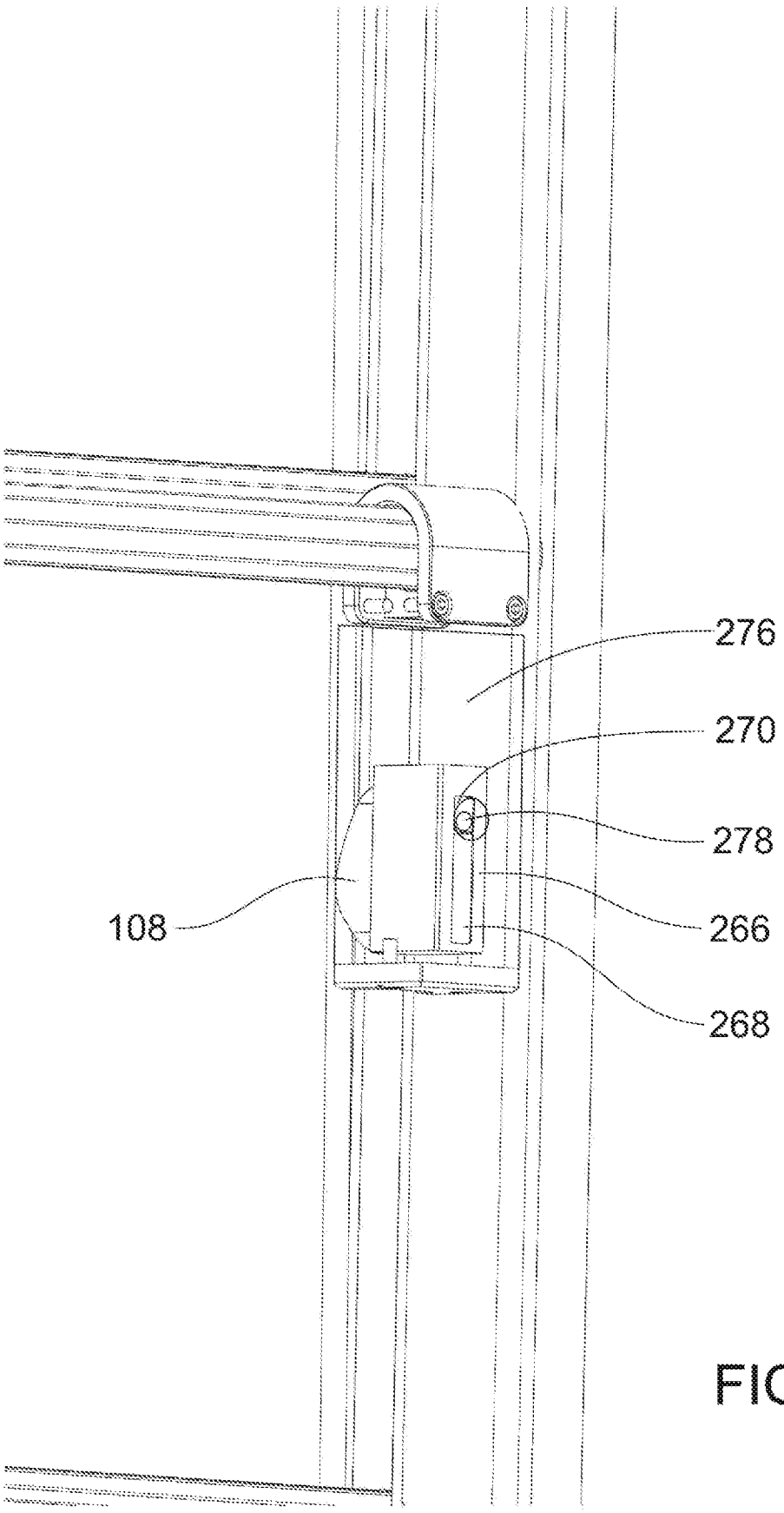
FIG. 16 illustrates a partially transparent perspective view of an opposite side of the cleat shown in FIG. 15.

With reference to the partially transparent views shown in FIGS. 15 and 16, the visual indicator 266 is replicated in the respective cleats 108 attached to one of the lower rungs 106 of the ladder 102 to indicate to the user at the bottom of the ladder whether the respective clamps 110 are in a locked or unlocked position. The rope or cable 122 connected to the wedge 260 is routed through the ladder 102 and held within the cleat 108. The cleat 108 is attached to a block 275 which is slidably held within a housing 276. The block 275 is biased via a spring or other biasing element corresponding to the position of the wedge 260 in the respective clamp 110. The housing 276 is affixed to one of the rungs 106 via any suitable bracket 280. As shown in FIG. 16, a face of the block 275 comprises the first, larger region 268 and second, smaller region 270 of the visual indicator 266, one or other of which is visible through an aperture 278 in the housing 276 to indicate the locked or unlocked state of the respective clamp 110.

The rope or cable 122 connected to the wedge 260 is routed through the ladder 102 in a figure eight configuration to maintain substantially the same tension in the rope or cable 122 as the first and second ladder sections 103A, 103B are moved relative to each other.

In alternative embodiments, certain further variations and alternatives are envisaged. For example, the kidney shaped cam 252 can be replaced with a spring activated cam to achieve a similar pivoting effect. For example, a ratchet and pawl mechanism can be used with the slider block 254. For example, the claw arms 248A, 248B can be replaced with a single claw arm that spans the space between the jaws 244. For example, the latch 262 for retaining the wedge 260 in a disengaged position can be replaced with any suitable mechanism that retains the wedge in position. It is envisaged that a single clamp 110 can be employed to secure the ladder 102 to a structure located, for example centrally on the ladder, however, it is preferred to keep the central region of the rungs 106 free to avoid trip hazards or obstructions. It is envisaged that the orientation of the clamps 110 can be rotated, for example, by 90 degrees from the position shown in the drawings. This would enable the clamps 110 to be secured to a structure in a forward motion rather than a downward motion, which may be preferred in certain applications. It is also envisaged that more than one clamp 110 can be operated with a single actuator 120, such as a single rope/cable 122.

Hence, the at least one clamp 110 of the present invention secures the ladder 102 in position to prevent the ladder from falling away from a structure or sliding sideways. The ladder can be secured in position by a user located at the bottom of the ladder, such as at ground level or on an elevated platform when trying to reach a greater height. The ladder 102 is therefore secured in position before even the first user of the ladder climbs the ladder, unlike some of the prior art devices. The fall protection device 130 provides fall safety for the user in the event that they fall from the secured ladder. However, since the ladder 102 is secured, the fall protection device 130 is also secured. Furthermore, embodiments of the present invention ensure that users are attached to the fall protection device before they ascend the ladder.

The ladder safety mechanism of 100 the present invention including the fall protection device 130 therefore provides compliance with fall safety regulations, for example in work environments, such as building sites. The position(s) of the one or more clamps 110 can be adjustable along the length of the ladder 102 and the orientation of the clamp can be adjustable rendering the ladder adaptable to many applications. The ladder safety mechanism is also lightweight, thus maintaining portability of the ladder. The parts of the safety mechanism, such as the at least one clamp 110, the actuator 120, the fall protection device 130 and/or the stabiliser can be retrofitted to the ladder. Therefore, these features can be attached to existing ladders at work sites, including in some cases fixed ladders and fire escape ladders.

Embodiments of the present invention thus benefit users of ladders, those responsible for users of ladders, and society as a whole by providing ladder safety mechanisms that protect users from fall injuries and conform to safety regulations, for example on building sites. The present invention also provides the benefit that the ladder safety device is retro-fittable to existing ladders, so businesses do not need to purchase new ladders. Embodiments of the ladder safety system do not require drilling of the ladder structure or cause any other damage to the ladder such that the warranty for the ladder is preserved and the ladder can be returned to its original state if required.

Embodiments of the ladder safety system are capable of securing the ladder to structures having a range of sizes. For example, for circular rails or the like, one embodiment of the present invention can secure a ladder to rails having a diameter of 30-60 mm whilst minimising the gap between the rail and the at least one claw arm 248.

Embodiments of the safety mechanism automatically secure the one or more clamps 110 to the part of the structure by placing the clamp onto the part of the structure, for example by virtue of contact with the slider block 254 and the pivotal connections to the claw arms. Therefore, the clamps are easily secured to the structure by the user at ground level, which makes the ladder safety mechanism particularly useful in low light level conditions, such as at night or in mines or the like.

The invention provides the further benefit of enabling a ladder to lock safely onto scaffolding or other common structures that a ladder is used near on building sites, and once the ladder is secure, protect the user of the ladder from dangerous falls, for example by limiting the fall speed of the user rather than stopping the fall of the user, so that the user will not suffer injury, such as whiplash, from a sudden deceleration.

Embodiments of the present invention are manually operated, thus requiring no electronics or power. Therefore, batteries do not need to be replaced and there is no risk of failure of the safety system due to a flat battery. Embodiments of the present invention can also be used where there is no mains power, unlike some of the prior art solutions.

Embodiments of the system include dear visual indicators to indicate to a user at ground level when the one or more clamps 110 are securely attached to a structure and when the clamps are unlocked. Embodiments of the system can also include clear visual indicators to indicate to a user when the slider 216 holding the clamp 110 is securely locked in position on the track 200 or is unlocked.

In this specification, adjectives such as first and second, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

In this specification, the terms "comprises", "comprising" or similar terms are intended to mean a non-exclusive inclusion, such that an apparatus that comprises a list of elements does not include those elements solely, but may well include other elements not listed.

Throughout the specification the aim has been to describe the invention without limiting the invention to any one embodiment or specific collection of features. Persons skilled in the relevant art may realize variations from the specific embodiments that Will nonetheless fall within the scope of the invention.

The invention claimed is:

1. A ladder safety mechanism comprising:

two clamps, each clamp attachable part way along a separate rail of a pair of spaced apart rails of a ladder, each clamp comprising a pair of spaced apart jaws to hook over a part of a structure and at least one claw arm pivotally mounted to a housing of the clamp, each at least one claw arm closable to secure the part of the structure between the jaws to secure the ladder to the part of the structure;

at least one manually operated actuator coupled to the at least one claw arm of each clamp to enable a user located at the bottom of the ladder to open each clamp to release the part of the structure from between the jaws; and a pair of tracks removably attachable to the ladder wherein each clamp is slidable along a respective track of the pair of tracks;

wherein the at least one claw arm of each clamp is also pivotally mounted to a respective slider block movable within the housing of the respective clamp; and wherein contact of the part of the structure with the respective slider block pushes the respective slider block upwards and causes pivoting of the at least one respective claw arm relative to the respective slider block and relative to the housing as the at least one respective claw arm closes.

2. The ladder safety mechanism of claim 1, wherein each track of the pair of tracks is attachable to one of the following: one or more rungs of the ladder; or outside a rail of the ladder.

3. The ladder safety mechanism of claim 1, wherein each track of the pair of tracks is attachable to one or more rungs of the ladder with a u-shaped clamp.

4. The ladder safety mechanism of claim 1, wherein each clamp is slidably attached to a respective track of the pair of tracks via a slider which is lockable in one of a plurality of predetermined positions along the respective track.

5. The ladder safety mechanism of claim 4, wherein the slider comprises a pair of manually operated actuators to control insertion and withdrawal of a pair of respective pins into and from respective apertures in the respective track.

6. The ladder safety mechanism of claim 5, wherein each pin of the pair of respective pins is independently biased by a respective biasing element in a locked position when each pin is aligned with a respective aperture in the track.

7. The ladder safety mechanism of claim 5, wherein the slider comprises a visual indicator indicating whether the slider is in a locked position or an unlocked position.

8. The ladder safety mechanism of claim 7, wherein the visual indicator comprises coloured ends of the pair of respective pins which are visible through apertures in a body of the slider when the slider is in an unlocked position.

9. The ladder safety mechanism of claim 1, wherein the at least one claw arm of each clamp is:

pivotally mounted to the housing of the clamp and to the slider block such that a rate of opening or closing of the at least one claw arm is greater than a rate at which the slider block descends or ascends respectively; and/or pivotally mounted to the housing such that a gap between the part of the structure and the at least one claw arm is minimised irrespective of the size of the structure; and/or pivotally mounted to the housing of the clamp via one of the following: a movable pivot; a kidney shaped cam; a spring actuated cam.

10. The ladder safety mechanism of claim 1, wherein a wedge engages the slider block to lock the slider block and the at least one claw arm in position.

11. The ladder safety mechanism of claim 10, wherein the wedge is disengaged from the slider block to release the slider block and the at least one claw arm via the manually operated actuator connected to the wedge.

12. The ladder safety mechanism of claim 10, further comprising a biased latch to retain the wedge in a disengaged position without the need for the user to continue operating the manually operated actuator.

13. The ladder safety mechanism of claim 10, wherein clamp includes a visual indicator to provide a visual indication of when the clamp is in a locked position and in an unlocked position.

14. The ladder safety mechanism of claim 13, wherein the visual indicator is:

in the form of two coloured regions provided on a side of the wedge, wherein one or other of the two coloured regions is visible through an aperture in the housing of the clamp to indicate the clamp is in a locked position or an unlocked position; and/or replicated in a respective cleat attached to a lower rung of the ladder to indicate to the user at the bottom of the ladder whether the respective clamp is in a locked position or unlocked position.

15. The ladder safety mechanism of claim 1, wherein the manually operated actuator is in the form of a rope or cable routed through the ladder in a configuration to maintain substantially same tension in the rope or cable as first and second ladder sections of the ladder are moved relative to each other.

16. The ladder safety mechanism of claim 1, further comprising a fall protection device attachable to an upper portion of the ladder, the fall protection device attachable to the user.

17. The ladder safety mechanism of claim 16, further comprising one of the following to ensure a connector of the fall protection device is at the bottom of the ladder for connection to the user before they ascend the ladder:

a fly lead attached at one end to the connector and secured at the other end at or toward the bottom of the ladder;

a retracting mechanism affixed at or toward the bottom of the ladder, the retracting mechanism comprising a retractable line coupled to the connector;

a rope or line loop mounted to a rail of the ladder and the connector coupled to the loop.

18. The ladder safety mechanism of claim 1, wherein each clamp is oriented substantially perpendicularly to a part of the structure to which the ladder is to be attached.

19. The ladder safety mechanism of claim 3, wherein the u-shaped clamp comprises a toe to prevent rotation of the u-shaped clamp about the rung.

20. The ladder safety mechanism of claim 16, wherein the fall protection device comprises a speed limiter to limit a fall speed of the user.

21. A ladder comprising the ladder safety mechanism of claim 1.

* * * * *